US006792703B2

(12) United States Patent
Cohen

(10) Patent No.: US 6,792,703 B2
(45) **Date of Patent: *Sep. 21, 2004**

(54) THERAPEUTIC SHOE

(75) Inventor: Shimon Cohen, 9/3 Nurit St., 44413 Kfar Saba (IL)

(73) Assignee: Shimon Cohen, Delray Beach, FL (US)

( * ) Notice: Subject to any disclaimer, the term of this patent is extended or adjusted under 35 U.S.C. 154(b) by 84 days.

This patent is subject to a terminal disclaimer.

(21) Appl. No.: 09/985,079

(22) Filed: Nov. 1, 2001

(65) Prior Publication Data

US 2002/0059739 A1 May 23, 2002

Related U.S. Application Data

(63) Continuation-in-part of application No. 09/449,748, filed on Nov. 26, 1999, now Pat. No. 6,311,416.

(51) Int. Cl.[7] ..... A43B 23/00

(52) U.S. Cl. ..... 36/136; 36/140; 36/15; 36/115

(58) Field of Search ..... 36/140, 141, 173, 36/136, 15, 115, 116, 117.1, 117.3, 117.4, 68, 69, 72 B, 92, 103, 1, 1.5, 110; 602/65, 27, 28

(56) References Cited

U.S. PATENT DOCUMENTS

| | | | | | |
|---|---|---|---|---|---|
| 194,361 | A | * | 8/1877 | McGuigan | 36/58 |
| 1,189,329 | A | | 7/1916 | Winagle | |
| 1,332,047 | A | * | 2/1920 | Lasher | 602/27 |
| 1,381,290 | A | * | 6/1921 | Diadul | 602/16 |
| 1,558,192 | A | | 10/1925 | Lindgren | |
| 2,095,942 | A | | 10/1937 | Wetterstrand | |
| 2,510,654 | A | | 6/1950 | Pepin | |
| 2,734,286 | A | | 2/1956 | Anson | |
| 3,019,534 | A | | 2/1962 | Kauffman et al. | |
| 3,677,567 | A | | 7/1972 | Salomon | |
| 3,827,430 | A | * | 8/1974 | Fadden | 602/28 |
| 3,859,991 | A | * | 1/1975 | Theodores | 602/28 |
| 4,291,473 | A | | 9/1981 | Sartor | |
| 4,441,264 | A | | 4/1984 | Hantz-Guibas et al. | |
| 4,459,764 | A | | 7/1984 | Beck | |
| 4,598,484 | A | | 7/1986 | Ma | |
| 4,662,082 | A | | 5/1987 | Shabazz | |
| 4,738,262 | A | | 4/1988 | Zebrack | |
| 4,774,775 | A | | 10/1988 | Pruitt | |
| 4,776,108 | A | * | 10/1988 | Bayless | 36/1 |
| 4,821,432 | A | | 4/1989 | Reiber | |
| 5,005,301 | A | | 4/1991 | Mabboux | |
| 5,029,575 | A | | 7/1991 | Zhivotchenko et al. | |
| 5,070,867 | A | | 12/1991 | March | |
| 5,170,574 | A | | 12/1992 | Weisbrich | |
| 5,176,624 | A | | 1/1993 | Kuehnreich | |
| 6,311,416 | B1 | * | 11/2001 | Cohen | 36/136 |

* cited by examiner

*Primary Examiner*—Jila M. Mohandesi
(74) *Attorney, Agent, or Firm*—Mark M. Friedman

(57) ABSTRACT

A therapeutic shoe for shifting the weight exerted on the foot of a wearer or for elevating the foot from the ground as required has a sole and an upper portion configured to retain the foot of the wearer in contact with the sole. A recessed track, formed in the lower surface of the sole, extends parallel to the length of the sole and along a major portion of its length. At least one support block is provided for attachment to the lower surface of the sole at any of a plurality of positions along the entirety of the recessed track. Also provided is a heel protection configuration and sole thickness adjustment platform.

14 Claims, 15 Drawing Sheets

A–A

THERAPEUTIC SHOE

This application is a continuation in part of U.S. patent application Ser. No. 09,449,748, filed Nov. 26, 1999 now U.S. Pat. No. 6,311,416.

FIELD AND BACKGROUND OF THE INVENTION

The present invention relates to therapeutic shoes and, in particular, it concerns shoes suited for mass production, which allow selective and personalized weight shifting to effect pressure relief to specific regions of the foot and allow selective adjustment of the height of the shoe.

Various patients require relief of pressure from parts of their feet, either as part of the treatment for an existing medical condition or prophylactically. This is particularly true for patients prone to peripheral circulatory problems such as diabetics. Pressure control is also often required or desirable during postoperative recovery or due to other sources of foot trauma.

Relief of pressure from one part of the foot can be achieved by modifying a shoe so that weight is transferred to other parts of the foot. Since the region in which pressure relief is required varies from patient to patient, this approach requires manual modification of shoes on an individual basis. Such an approach is labor intensive and costly. The shoe, once modified, is useless when the pressure relief therapy is no longer required.

A related problem, particularly in patients prone to peripheral circulatory problems, results from extended periods of localized pressure on the heel of a bedridden patient.

A different problem results from what is known in the field of orthopedics as LLD (Leg Length Discrepancy). As a result of medical intervention such as hip surgery, one leg of the patient may become shorter than the other leg. The resulting discomfort when walking forces the patient to be bedridden until custom orthopedic shoes can be made, a process which can take more than a month.

There is therefore a need for a therapeutic shoe suitable for mass production which allows readily adjustable weight shifting, which offers protection to the heel from pressure while sleeping, and which allows the shoe to be used as a conventional shoe at other times. There is also a need for a therapeutic shoe which can quickly and easily be adjustable to effectively raise the sole of a shoe to allow comfortable walking in the case of LLD.

SUMMARY OF THE INVENTION

The present invention is a therapeutic shoe.

According to the teachings of the present invention there is provided, a therapeutic shoe configured to raise the sole of the shoe at certain points along the shoe which also facilitates shifting the weight exerted on the foot of a wearer as required, the shoe comprising: (a) a sole providing an upper surface for supporting the foot of the wearer and a lower surface, the sole having a longest dimension; (b) an upper portion associated with the sole and configured to retain the foot of the wearer in contact with the sole; (c) a recessed track formed in the lower surface of the sole and extending substantially parallel to the longest dimension along a major portion of the longest dimension; and (d) a support block having an engagement projection configured for engaging the recessed track and a load-supporting body configured to extend in a direction substantially perpendicular to the longest dimension, the support block being configured so as to be attachable to the lower surface at any one of a plurality of positions along substantially the entirety of the recessed track.

According to a further feature of the present invention, the recessed track includes at least one undercut ridge, the recessed track being open at at least one end, and wherein the engagement projection is configured to engage the undercut ridge.

According to a further feature of the present invention, the recessed track is a substantially T-shaped track open at at least one end, and wherein the engagement projection is formed with a complementary T-shaped cross-section.

According to a further feature of the present invention, wherein the load-supporting body is formed with a rounded lower profile as viewed along its direction of extension.

According to a further feature of the present invention, there are also provided at least two threaded fastening elements for attaching the support block to the lower surface.

According to a further feature of the present invention, there is also provided an engagement projection made up of a multiplicity of parts including an engagement ridge and an attachment plate connected to the engagement ridge with a tightening means such as screws for attaching the support blocks to the lower surface of the shoe.

According to a further feature of the present invention, there is also provided an additional support block having an engagement projection configured for engaging the recessed track and a load-supporting body configured to extend in a direction substantially perpendicular to the length, both the support block and the additional support block being attachable at different positions along the recessed track.

According to a further feature, the present invention is additionally configured to avoid pressure on the heel of the foot of a supine wearer from an underlying surface, the upper portion being configured to retain the foot in a position such that the heel of the foot lies adjacent to the rear edge of the sole, the upper portion having at least one opening adjacent to the rear edge so as to avoid contact with at least a part of the heel of the foot, the shoe further comprising a pressure release bracket configured to releasably engage the sole so that the sole is supported by the pressure release bracket with the rear edge raised above the underlying surface.

There is also provided according to the teachings of the present invention, a therapeutic shoe configured to avoid pressure on the heel of a foot of a supine wearer, the shoe comprising: (a) a sole providing an upper surface for supporting the foot of the wearer, the sole having a rear edge; (b) an upper portion associated with the sole and configured to retain the foot of the wearer in contact with the sole in a position such that the heel of the foot lies adjacent to the rear edge, the upper portion having at least one opening adjacent to the rear edge so as to avoid contact with at least a part of the heel of the foot; and c) a pressure release bracket configured to releasably engage the sole so that the sole is supported by the pressure release bracket with the rear edge raised above the underlying surface, and to give some measure of protection to the heel from injurious or painful contact.

According to a further feature of the present invention, the sole features a slot adjacent to the rear edge, and wherein the pressure release bracket is implemented as a substantially flat sheet configured to engage the slot.

According to a further feature of the present invention, the sole features a slot adjacent to the rear edge, and wherein the pressure release bracket is configured to engage the slot, configured to redistribute the weight of the foot to the ankle and leg, and configured to substantially protect the heel from injurious or painful incidental contact.

According to a further teaching of the present invention, the shoe is additionally configured to facilitate shifting the weight exerted on the foot of a wearer as required, wherein the sole has a longest dimension, the shoe further comprising: (a) a recessed track formed in the lower surface of the sole and extending substantially parallel to the longest dimension along a major portion of the longest dimension; and (b) a support block having an engagement projection configured for engaging the recessed track and a load-supporting body configured to extend in a direction substantially perpendicular to the longest dimension, the support block being configured so as to be attachable to said lower surface at any one of a plurality of positions along substantially the entirety of the recessed track.

According to a further teaching of the present invention, the at least one opening is further open to portions of adjacent side edges on either side of the rear edge so as to avoid contact with at least part of the back and sides of the heel of the foot.

According to a further teaching of the present invention, the pressure release bracket is further configured to support the sole with at lease a part of one of the adjacent side edges raised above the underlying surface when the foot and leg are rotated to bring the adjacent side edge into contact with the underlying surface.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
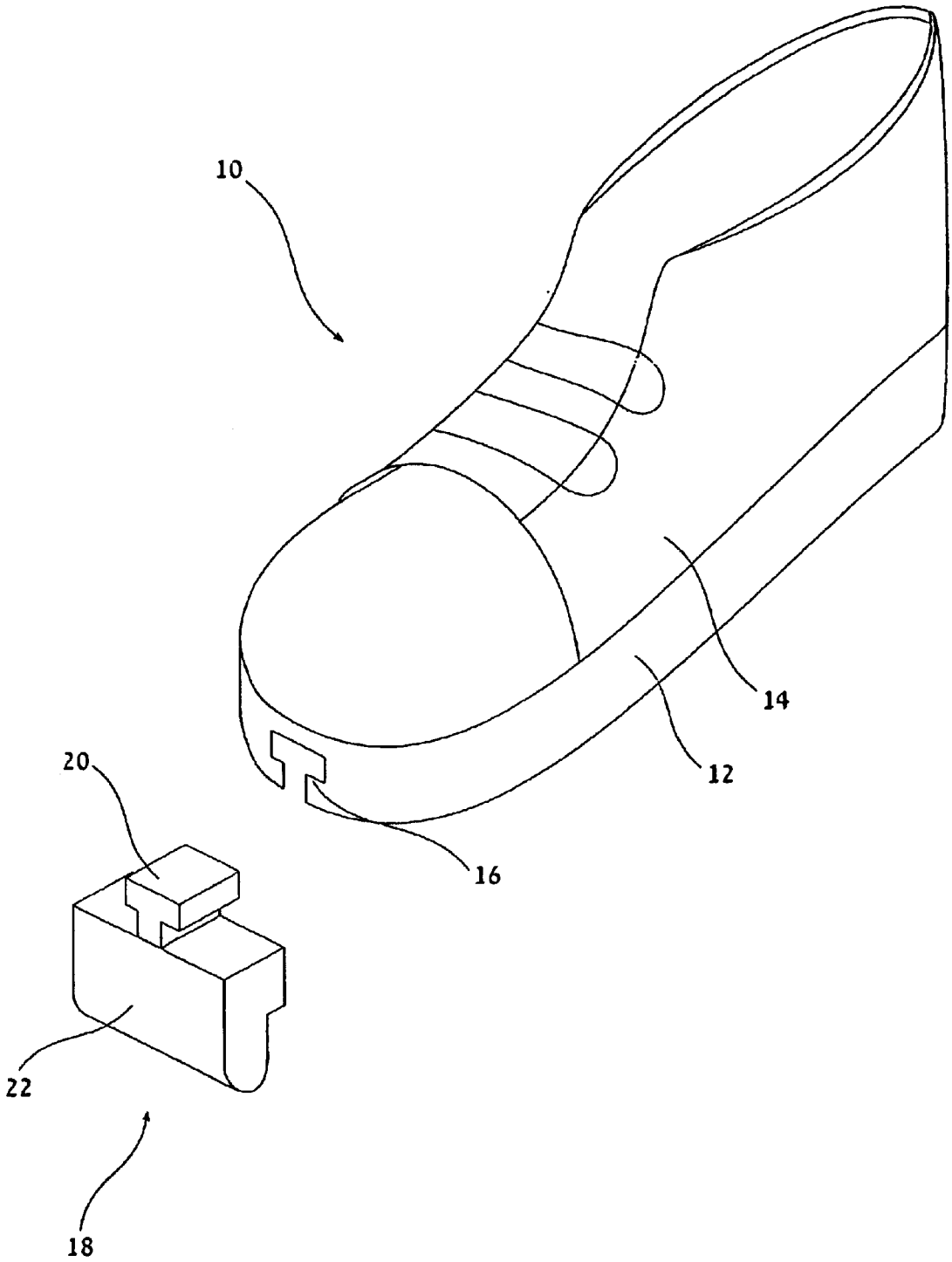
FIG. 1 is a schematic front isometric view of a first embodiment of a therapeutic shoe, constructed and operative according to the teachings of the present invention.
Figure 2:
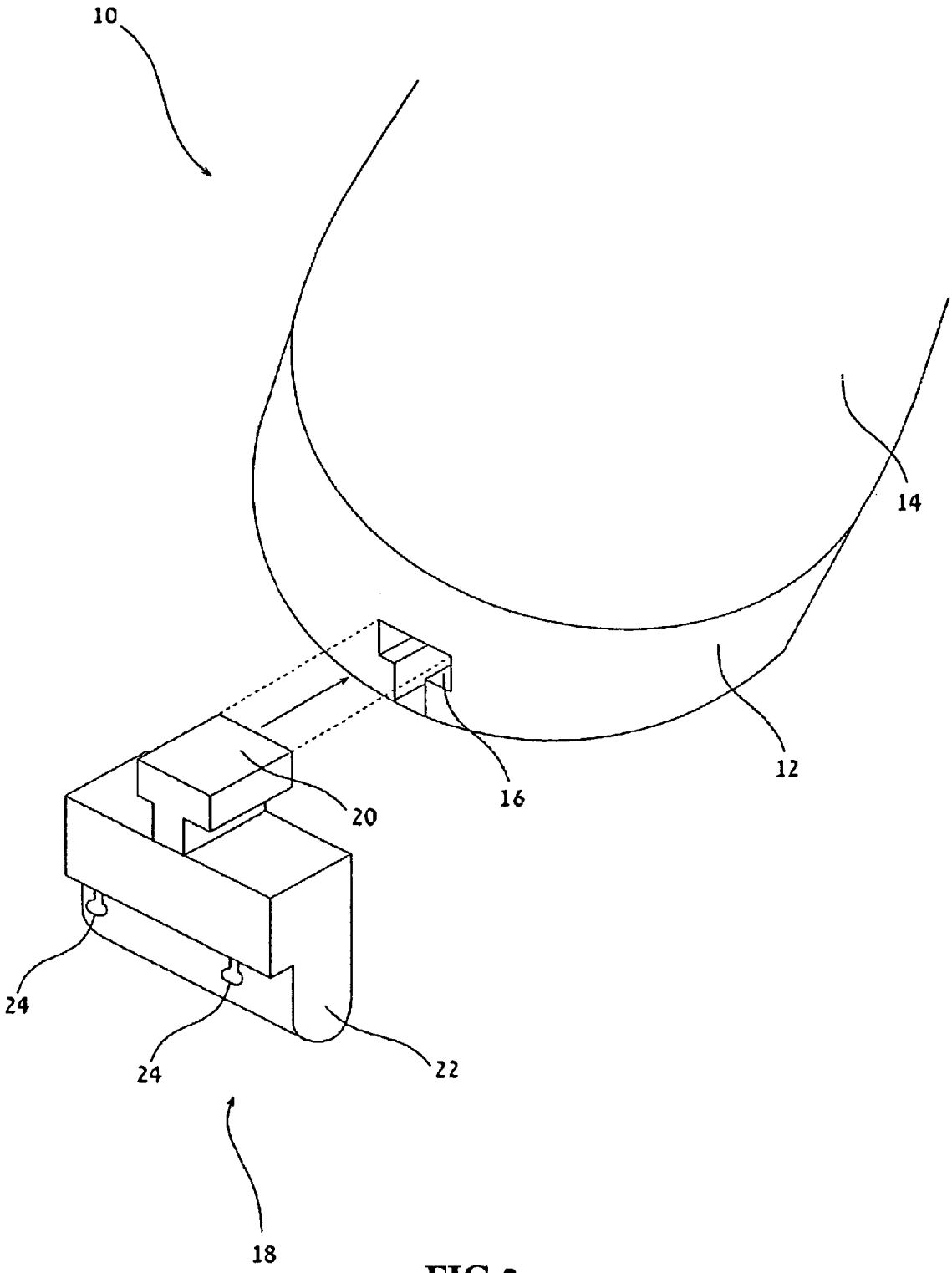
FIG. 2 is a schematic partial rear isometric view of the therapeutic shoe of FIG 1.

The present invention is a therapeutic shoe.

The principles and operation of shoes according to the present invention may be better understood with reference to the drawings and the accompanying description.

Before turning to details of the present invention, it should be appreciated that the present invention provides three sets of features, each of which may be used alone, or which may be combined to provide a particularly useful and versatile product. The first set of features, when relating to an adjustable weight-shifting configuration, will be described with particular reference to FIGS. 1–4 and when relating to relief of wearers suffering with LLD with reference to FIG. 5. The second set of features, relating to relief of pressure on the heel while supine, will then be described with reference to FIGS. 6–10. Finally, the third set of features, relating to adjusting the thickness of the sole of the shoe, will be described with references to FIGS. 11–13. Referring now to the drawings, FIGS. 1–4 show a first embodiment of a therapeutic shoe, generally designated 10, configured to facilitate shifting the weight exerted on the foot of a wearer (not shown) as required. Generally speaking, shoe 10 includes a sole 12 providing an upper surface for supporting the foot of the wearer, and an upper portion 14 associated with sole 12 and configured to retain the foot of the wearer in contact with the sole. A recessed track 16 is formed in the lower surface of sole 12 and extends substantially parallel to a dimension of the sole termed "length" along a major portion of the length. A support block 18 has an engagement projection 20 configured for engaging recessed track 16 and a load-supporting body 22 configured to extend in a direction substantially perpendicular to the length. Support block 18 is configured so as to be attachable to the lower surface of sole 12 at any one of a plurality of positions along substantially the entirety of recessed track 16.

It will be readily apparent that therapeutic shoe 10, formed from standard components suitable for mass production techniques, readily allows positioning of one or more support block 18 to offer personalized weight shifting and pressure release. Furthermore, support block 18 may subsequently be adjusted and, after the completion of the therapy, may be removed altogether to allow shoe 10 to be used as a normal shoe.

Figure 3A:
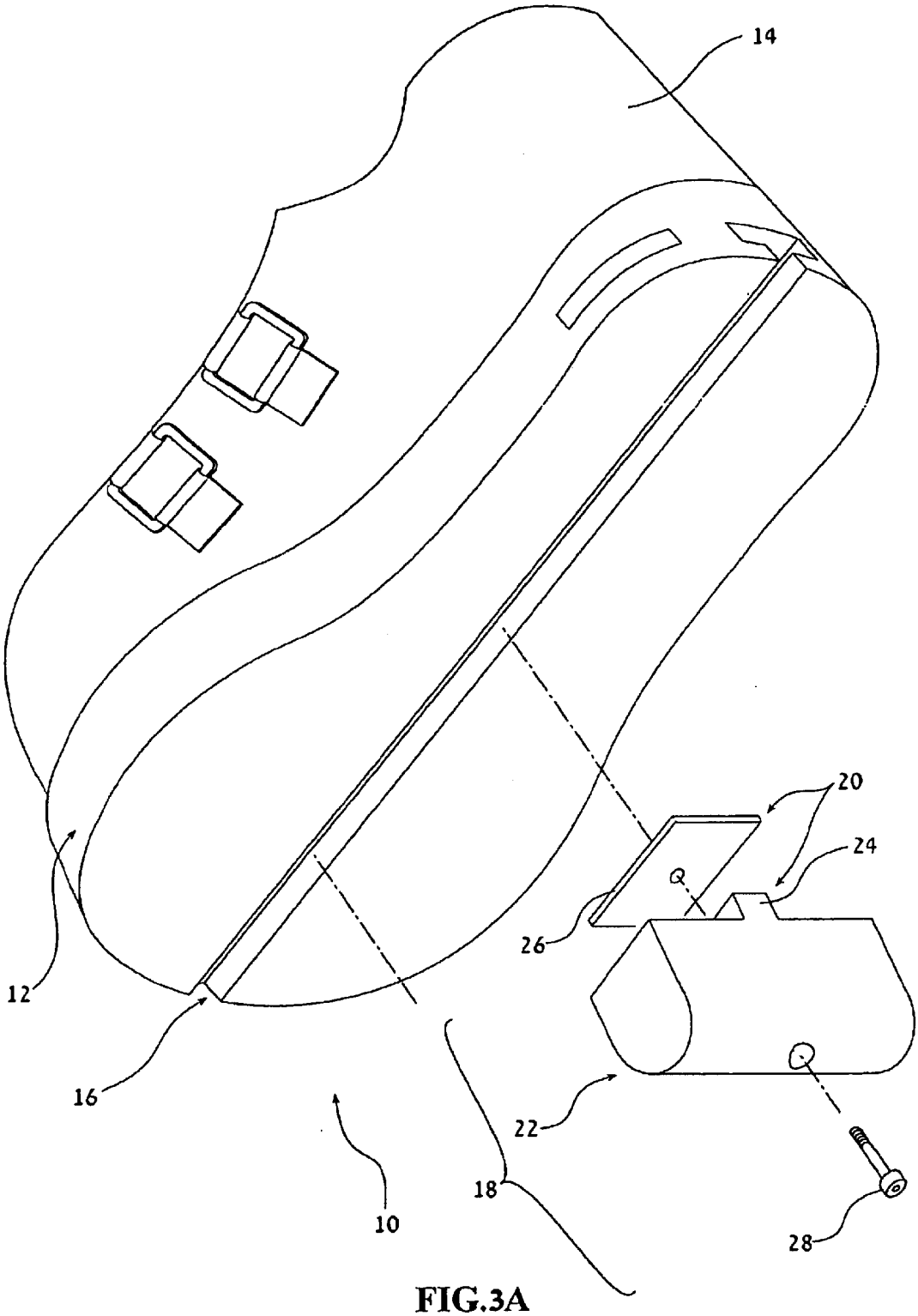
FIG. 3A is a schematic bottom isometric view of the therapeutic shoe of FIG. 1 with a multi-part engagement projection.

Turning now to the features of therapeutic shoe 10 in more detail, recessed track 16 is preferably open at at least one end of sole 12 and, most preferably, extends the full length of sole 12 so as to be open at both ends (see FIG. 3A). Optionally, in the case that both ends are open, track 16 may be interrupted at some point along its length, such as to provide a region of reinforcement for sole 12. Track 16 preferably includes at least one undercut ridge, most preferably in the form of a substantially T-shaped track, as shown.

Engagement projection 20 is preferably configured to engage the undercut ridge of track 16. In the case of a T-shaped slot, engagement projection 20 is preferably formed with a complementary T-shaped cross-section. This serves to retain support block 18 against sole 12, and to define both the lateral position and the orientation of support block 18 relative to sole 12 There remains only one degree of freedom for adjustment of the support block, namely, in the frontward-rearward directions relative to sole 12.

The required position of each support block 18 along track 16 is preferably fixed by tightening of one or more fastening element which extend through block 18 into sole 12. Preferably, these are implemented as at least two threaded fastening elements 24, typically in the form of self-drilling screws, which are inserted through a fastening flange of the support block (see FIG. 2) and are configured to become lodged in sole 12 when tightened.

Figure 3B:
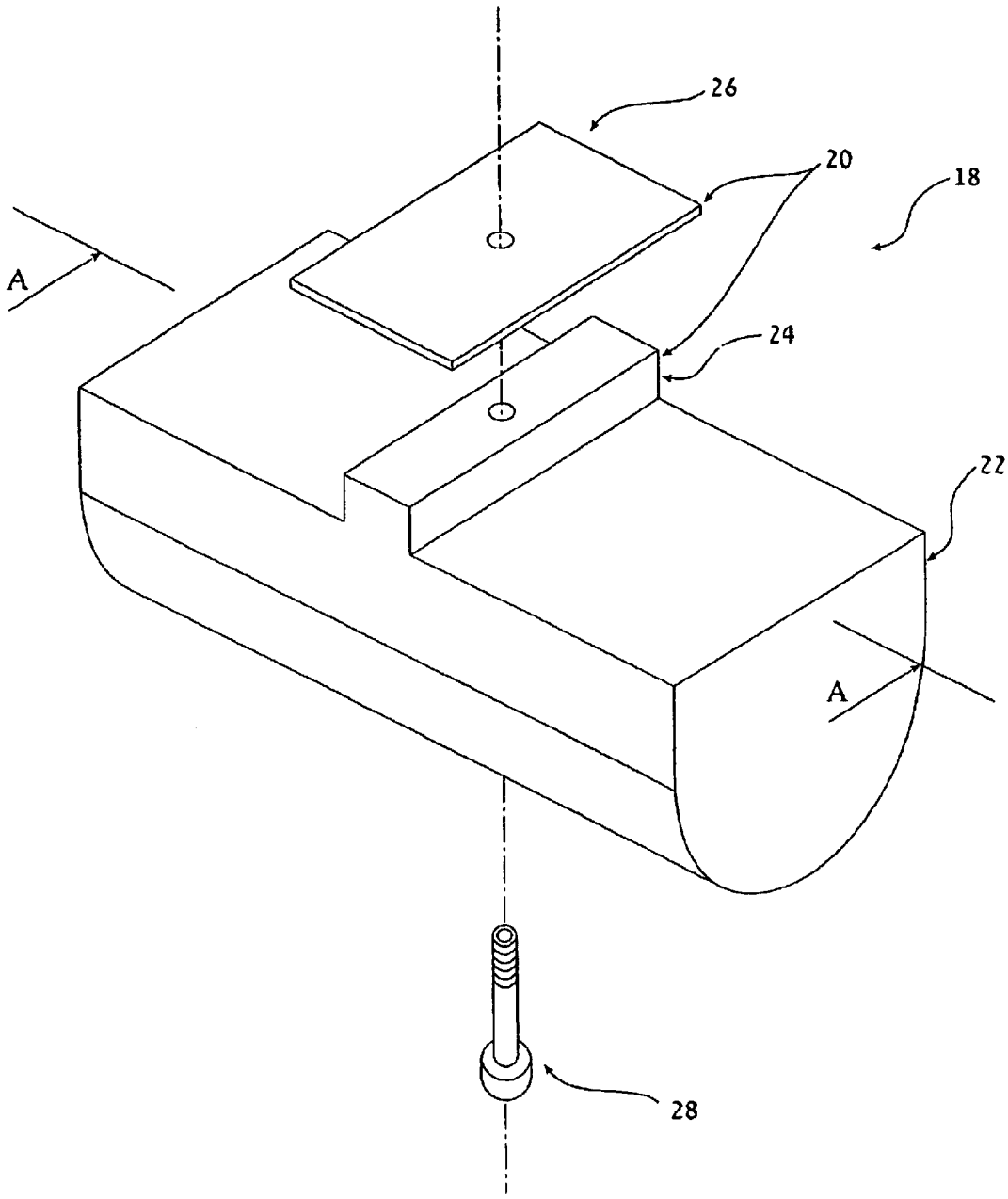
FIG. 3B is a schematic isometric view of the supporting body with a multi-part engagement projection.

Alternatively, the engagement projection is preferably made up of a number of parts, as illustrated in FIGS. 3A and 3B. In FIGS. 3A and 3B, a three-pieced embodiment of support block 18 is shown, where load-supporting body 22 is permanently associated with engagement ridge 24 and where attachment plate 26 can be operationally connected to it in some way, such as by using screw 28. Tightening screw 28 into threads in attachment plate 26 while engagement ridge 24 is engaged in track 16 reduces the gap between attachment plate 26 and load-supporting body 22, squeezes the edges of undercut track 16 and so retains support block 18 in place against sole 12. Engagement ridge 24 defines both the lateral position and the orientation of support block 18 relative to sole 12. The pressure exerted by attachment plate 26 and load supporting body 22 by the action of screw 28 produces sufficient frictional force that support block 18 remains substantially immobile relative to sole 12.

The position of support block 18 along track 16 is preferably adjusted by releasing screw 28 so as to reduce the pressure exerted on the sole by engagement projection 20, allowing support block 18 to slide along the recessed track while engagement projection remains substantially engaged in track 16. Re-tightening screw 28 fixes support block 18 in the desired place along the length of sole 12, Load-supporting body 22 typically has a height (i.e., the extent to which sole is raised locally above the underlying surface) of up to about 2 cm. Depending upon the intended therapy, heights of either about 2 cm or about 1 cm are thought to be preferred. In order to make walking as comfortable as possible, load-supporting body 22 preferably has a rounded lower profile as viewed along its direction of extension, i.e., from the side as seen in FIGS. 4A–4D. Furthermore, load-supporting body 22 typically extends across at least half the width of the sole of the shoe to maximize stability and comfort when walking and to evenly distribute pressure along the width of the foot of the wearer.

Figure 4A:
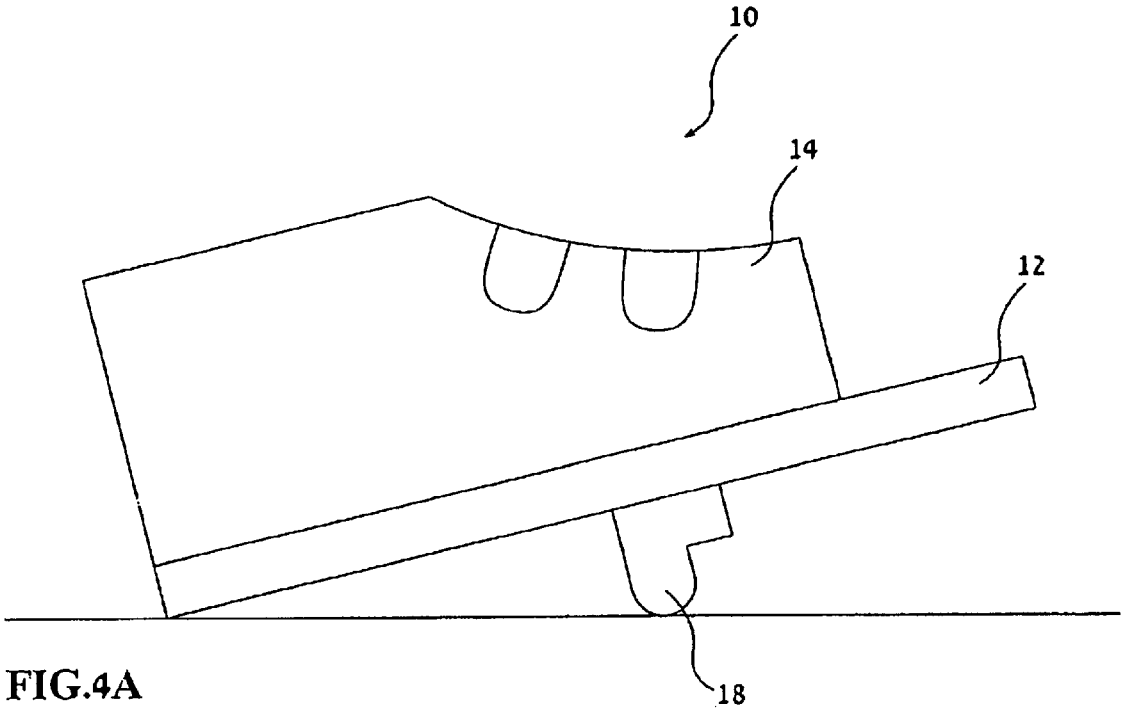
FIGS. 4A–4D are four schematic side views showing different applications of the shoe of FIG 1.
Figure 4B:
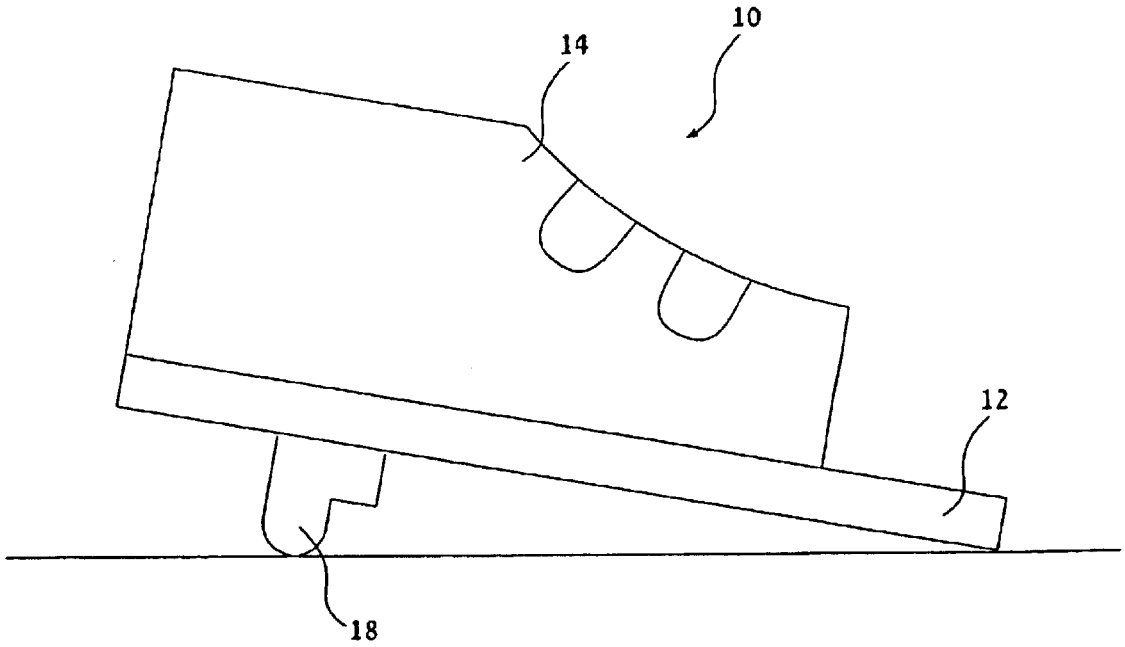

Turning now to FIGS. 4A–4D, these show four typical examples of configurations formed using therapeutic shoe 10 for pressure relief therapy. Referring first to FIG. 4A, this shows a configuration employing a single support block 18 located in a forward position, shifting weight to the rear of the foot and offering forefoot protection. FIG. 4B shows a second configuration, shifting the weight to the front of the foot thus providing heel protection.

Figure 4C:
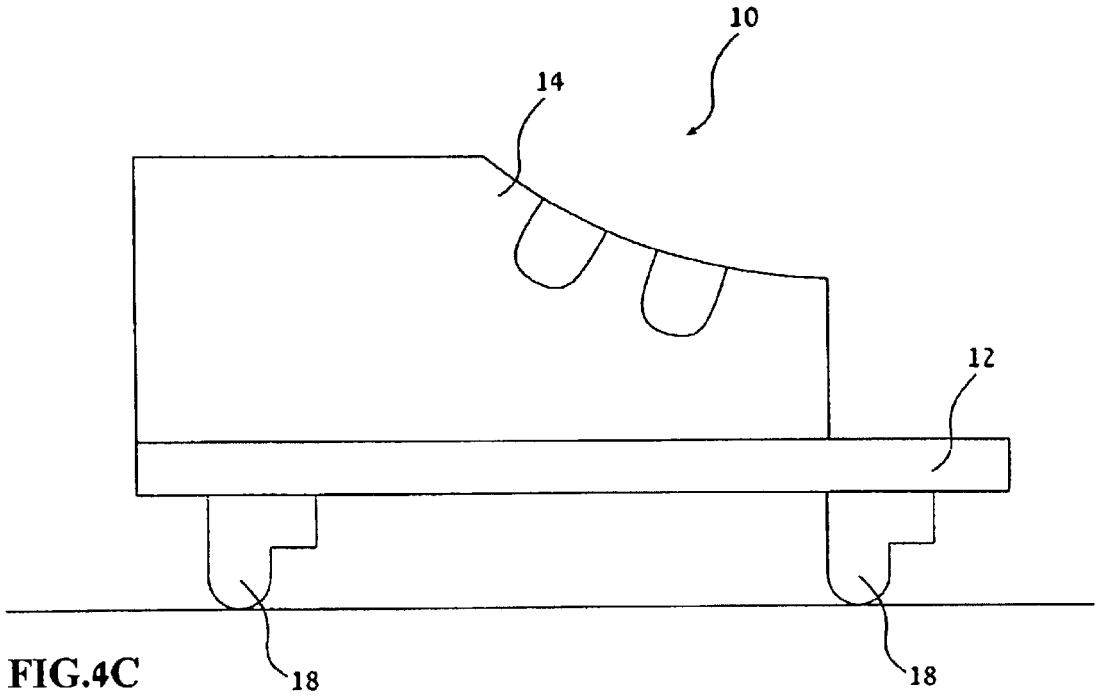
Figure 4D:
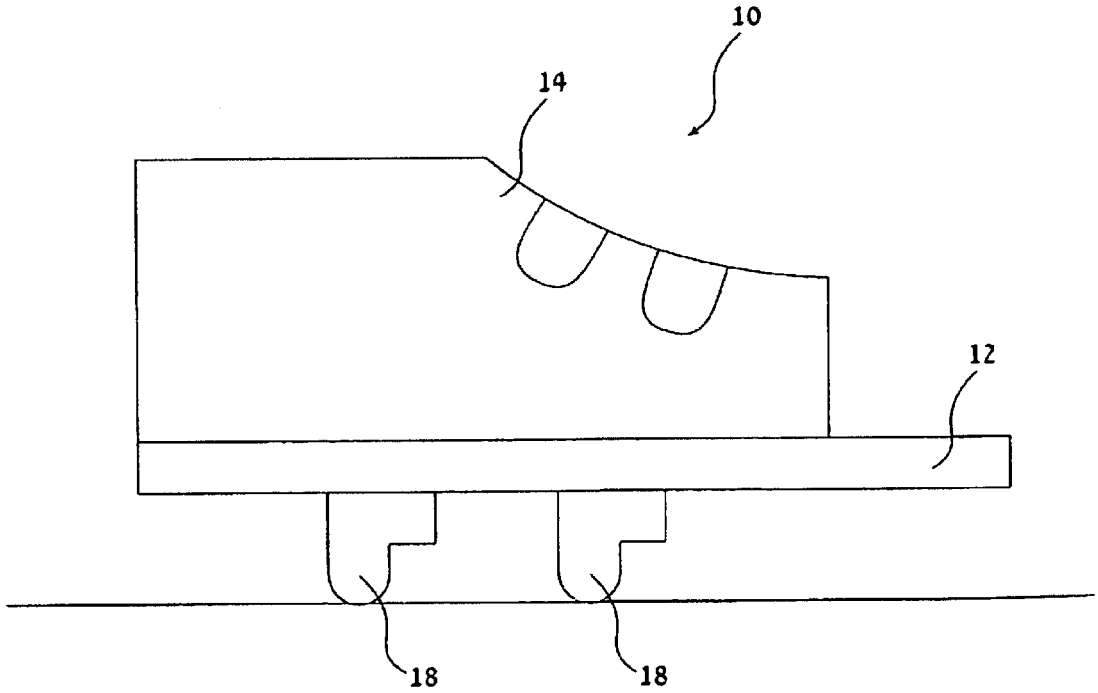

FIGS. 4C and 4D show further configurations in which two similar support blocks 18 are attached at different positions along track 16. In the configuration of FIG. 4C, the two supports are located at extreme positions to shift the weight to the front and back of the foot thus providing mid-foot protection. In FIG. 4D, they are brought inwards to shift the weight towards the center of the foot and thus to offer simultaneous forefoot and heel protection.

Figure 5A:
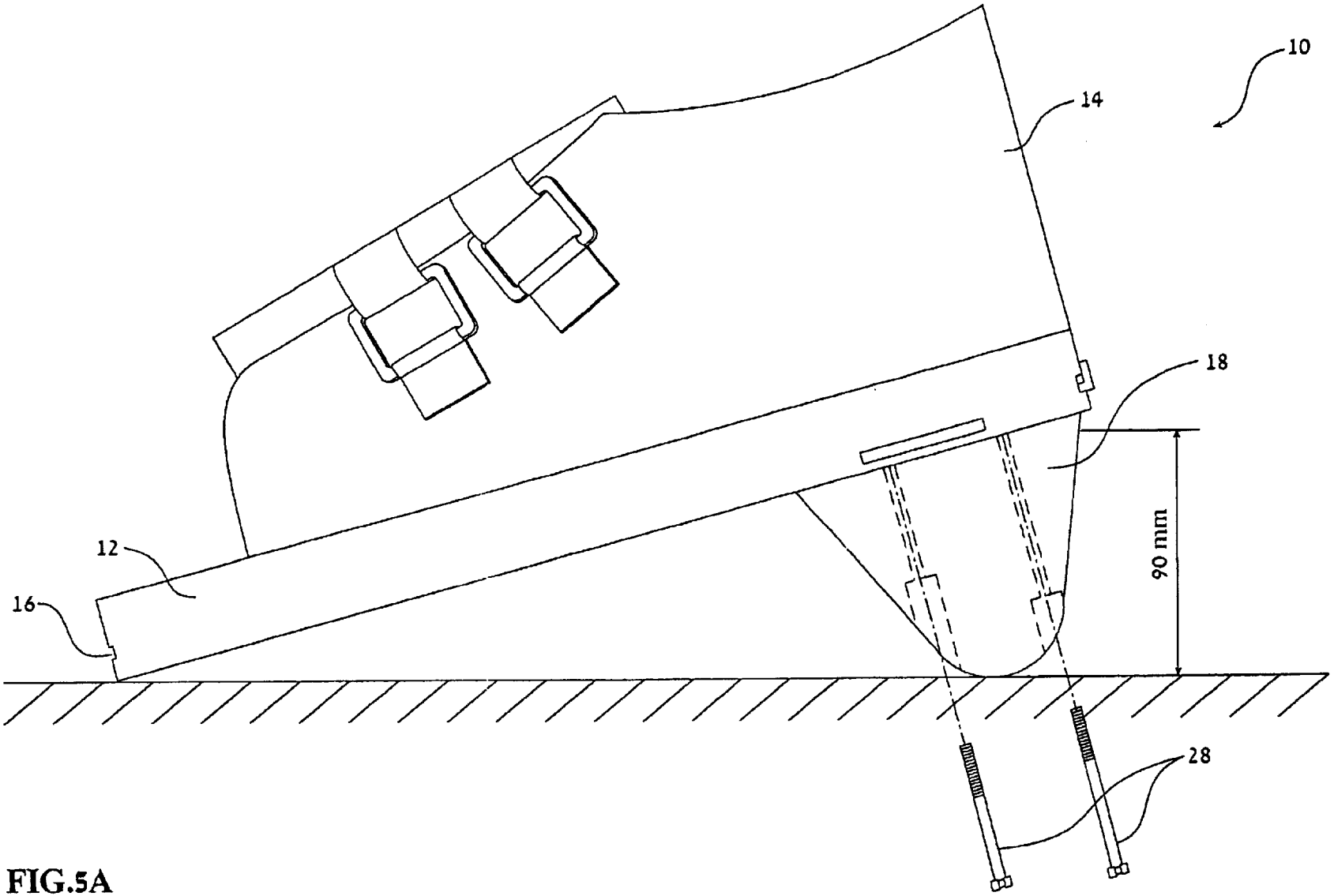
FIG. 5A is a schematic side isometric view of the shoe of FIG. 1, assembled using one support block to be useful for users having LLD.
Figure 5B:
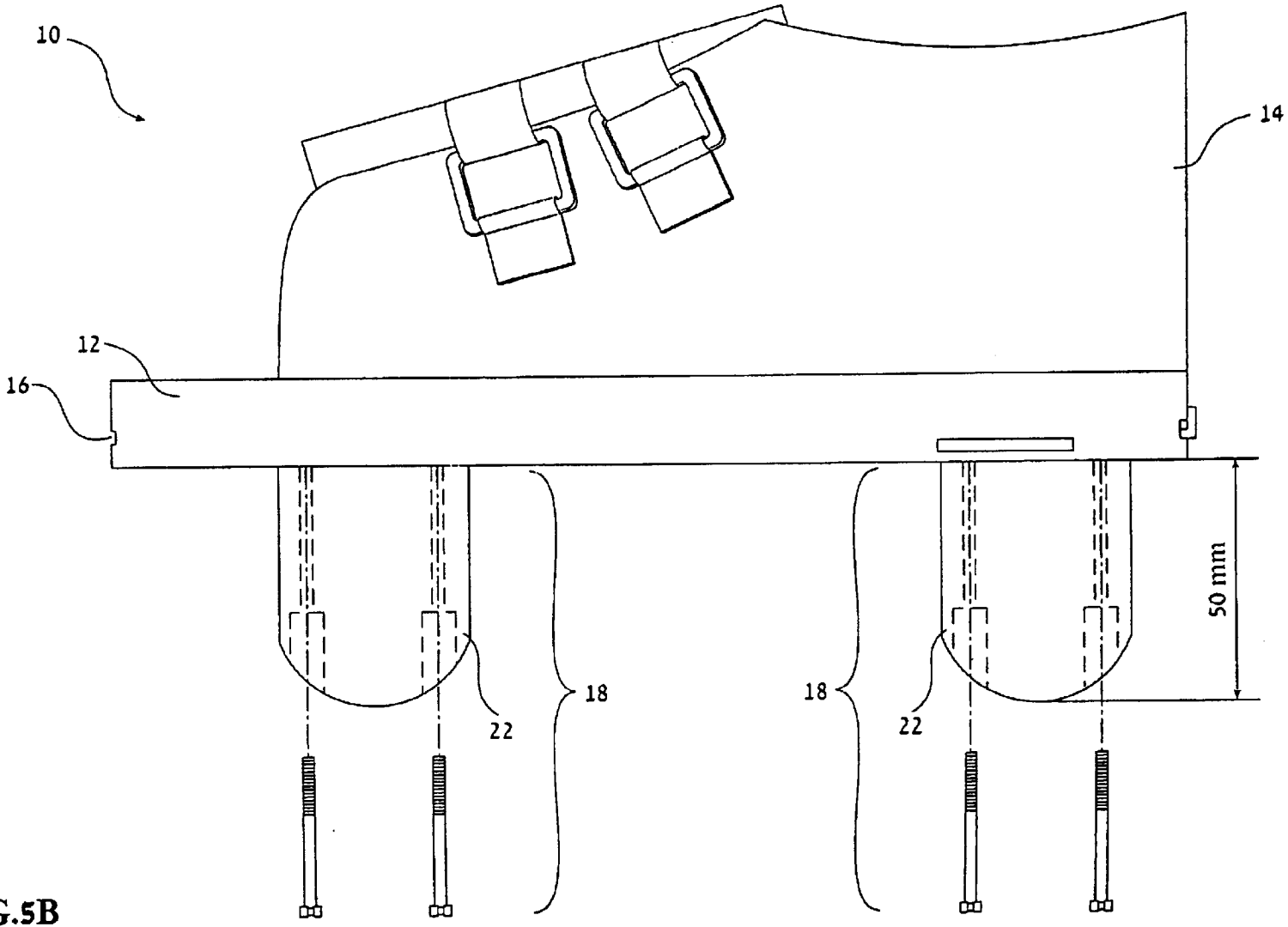
FIG. 5B is a schematic side isometric view of the shoe of FIG. 1, when assembled using two support blocks to be useful for users having LLD.
Figure 5C:
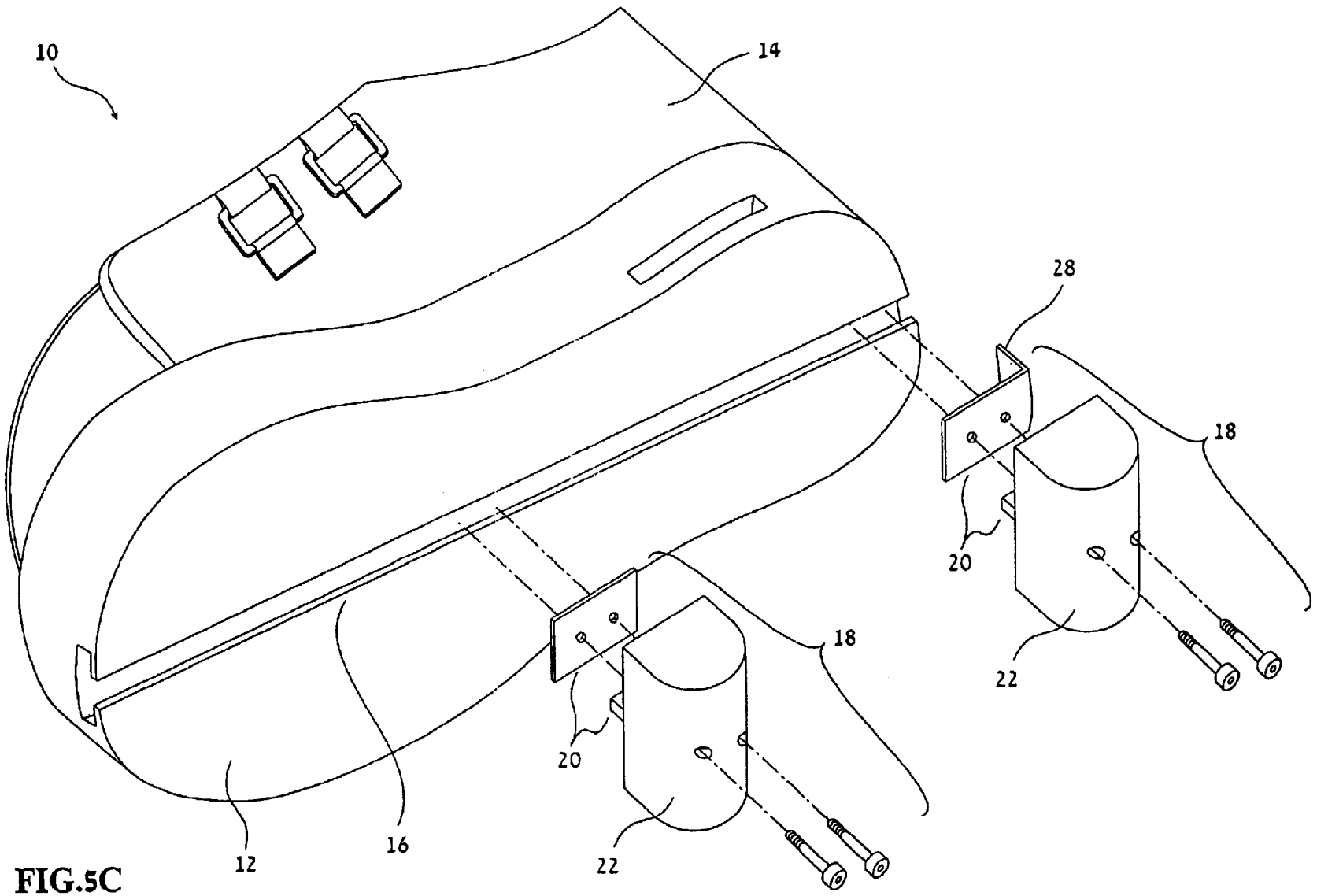
FIG. 5C is an exploded schematic bottom isometric view of the shoe of FIG. 5B.

FIGS. 5A–5C, illustrate typical examples of configurations of therapeutic shoe 10 useful for wearers suffering from LLD.

Referring first to FIG. 5A, this shows a configuration employing a single support block 18 located in the heel position, raising that part of the shoe so as to allow comfortable walking. In FIG. 5A, two screws are shown used to fix support block 18 in place.

FIGS. 5B and 5C shows a different configuration, where two support blocks 18 are used to raise sole 12 to be substantially parallel to the ground when the wearer is standing. Both the number of support blocks and the heights of each support block are decided upon, for example, by a physician. In FIG. 5C an additional embodiment of attachment plate a substantially L-shape 28 is shown. The L-shape allows simple adjustment of the location of support block 18 at the heel of the shoe.

As can be seen in FIG. 5A, when the invention is used to help wearers suffering from LLD, it is possible that support block 22 be somewhat wider to make more contact along the length of sole 12 so as to minimize the pressure distribution aspect of the invention. It is also possible to see in FIGS. 5A and 5B that, in order to compensate for the leg length discrepancy, load-supporting body 22 may raise sole 12 higher than in the case of pressure relief.

Sole 12 and load-supporting body 22 are each made from any suitable material. Typically, both are made from polymer materials of types conventionally used for shoe soles as are known in the art. Such materials inherently provide an appropriate degree of flexibility to distribute the weight of the wearer in a gradual manner over the region of sole 12 proximate to load-supporting body 22.

Similarly, upper portion 14 is made from any suitable material. Typically, it is formed from either leather or synthetic materials commonly used for shoe uppers. It should be noted that the type and style defined by the shape of upper portion 14 is not salient to the invention. Thus, in the particular preferred example illustrated here, upper portion 14 is formed with an open toe, thereby forming a sandal configuration. However, a closed-toe shoe is preferred for some applications.

Figure 6:
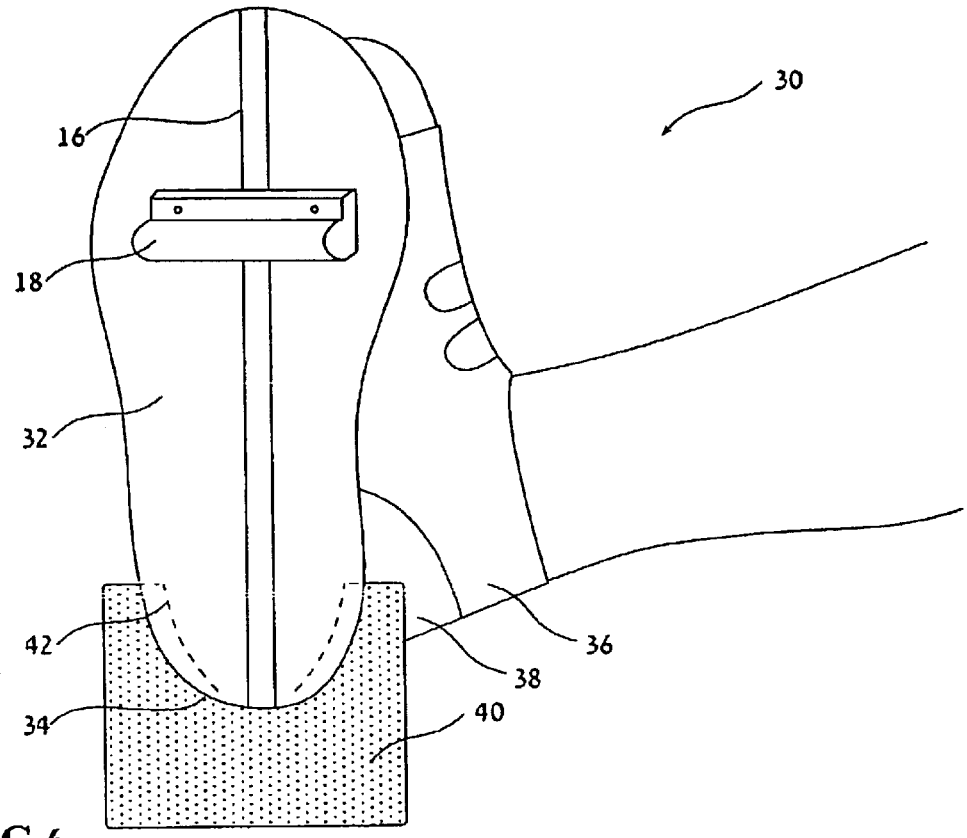
FIG. 6 is a schematic isometric view of a second embodiment of a therapeutic shoe, constructed and operative according to the teachings of the present invention, employing a pressure release bracket to protect the heel of a patient.
Figure 7:
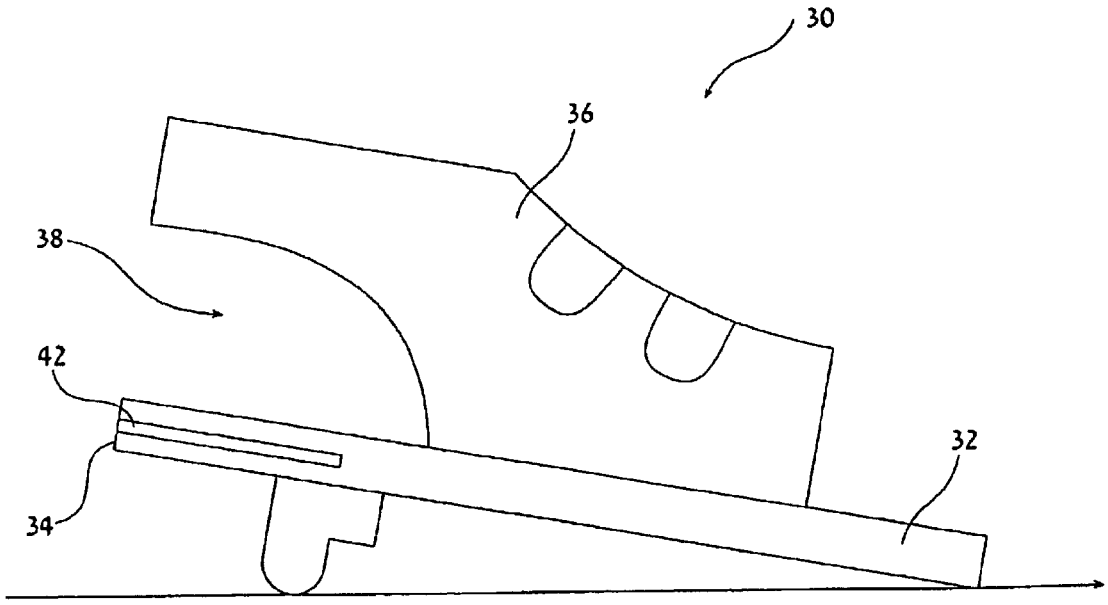
FIG. 7 is a schematic side view of the shoe of FIG. 6 with the pressure release bracket removed.

Turning now to FIGS. 6 and 7, as mentioned above, the present invention provides a second set of features which are used alone or, as shown, together with the features described above to avoid pressure on the heel of a foot supine wearer. Thus, a therapeutic shoe is shown, generally designated 30, constructed and operative according to the teachings of the present invention. Generally speaking, therapeutic shoe 30 has a sole 32 providing an upper surface for supporting the foot of the wearer, and having a rear edge 34. In this case, an upper portion 36, associated with sole 32, is configured to retain the foot of the wearer in contact with sole 32 in a position such that the heel of the foot lies adjacent to rear edge 34. Upper portion 36 has at least one opening 38 adjacent to rear edge 34 configured to avoid contact with at least a part of the heel of the foot. A pressure release bracket 40 is configured to releasably engage sole 32 so that the sole is supported by pressure release bracket 40 with its rear edge 34 raised above the underlying surface.

It will be appreciated that the structure described ensures that the heel of the wearer does not experience any contact pressure with the adjacent surfaces. Specifically, over a wide range of "heel-down" foot positions, the weight of the foot is always transmitted through sole 32 to upper portion 36 which is configured to retain the foot without exerting any pressure on the heel. When the wearer has finished resting and the heel protection function is not currently required, bracket 40 is readily removed, as shown in FIG. 7, to allow shoe 30 to be used for walking.

It will be appreciated that a wide range of structures can provide the function of pressure release bracket 40. In one particularly simple and preferred implementation illustrated in FIG. 6, pressure release bracket 40 is implemented as a substantially flat sheet of metallic or polymer material. In this case, sole 32 preferably features a slot 42 adjacent to rear edge 34 within which pressure release bracket 40 is configured to sedge or clip into place.

Figure 8:
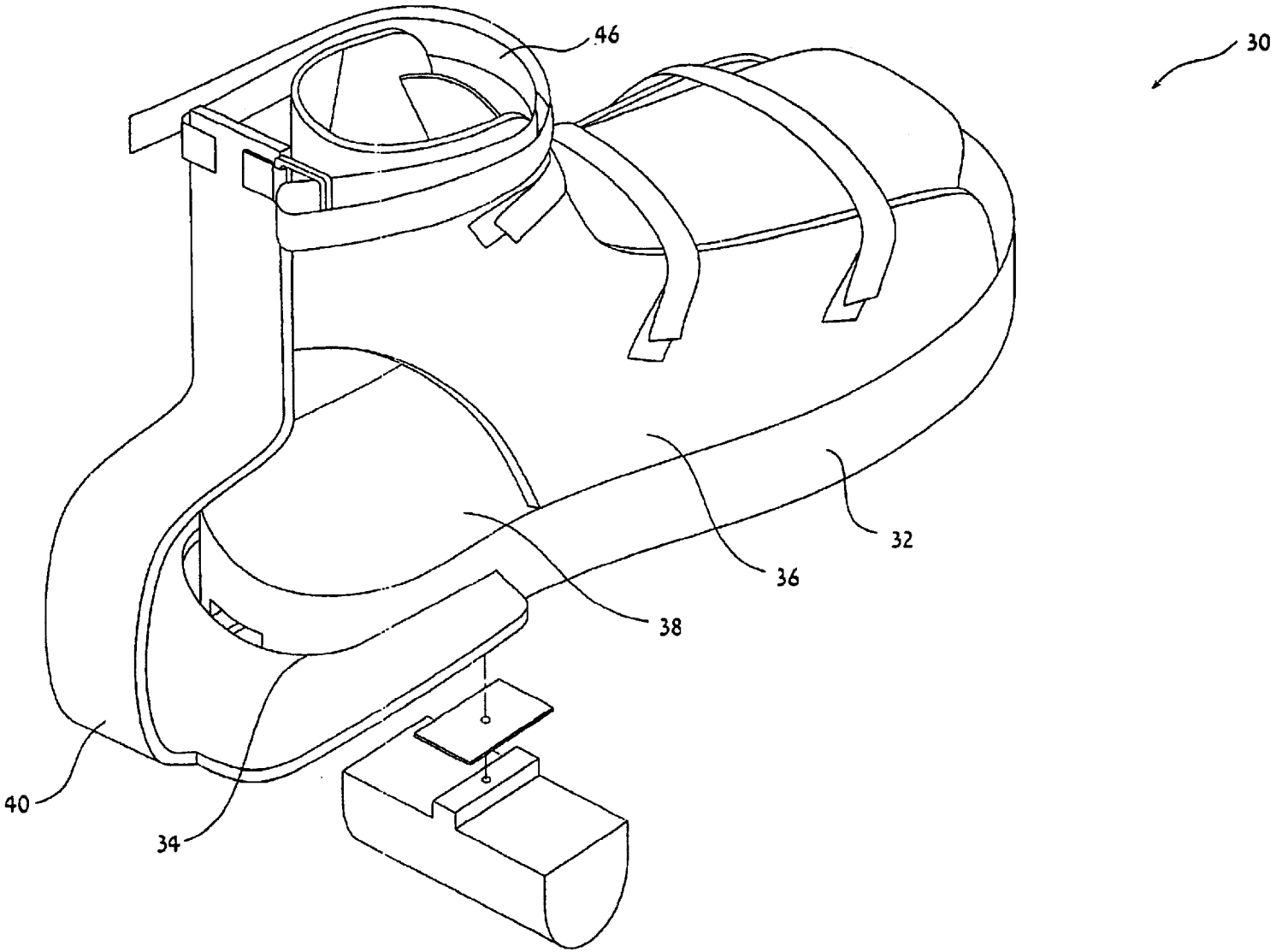
FIG. 8 is a schematic rear isometric view of an additional embodiment of a therapeutic shoe, constructed and operative according to the teachings of the present invention, employing an alternative pressure release bracket to protect the heel of a patient.
Figure 9:
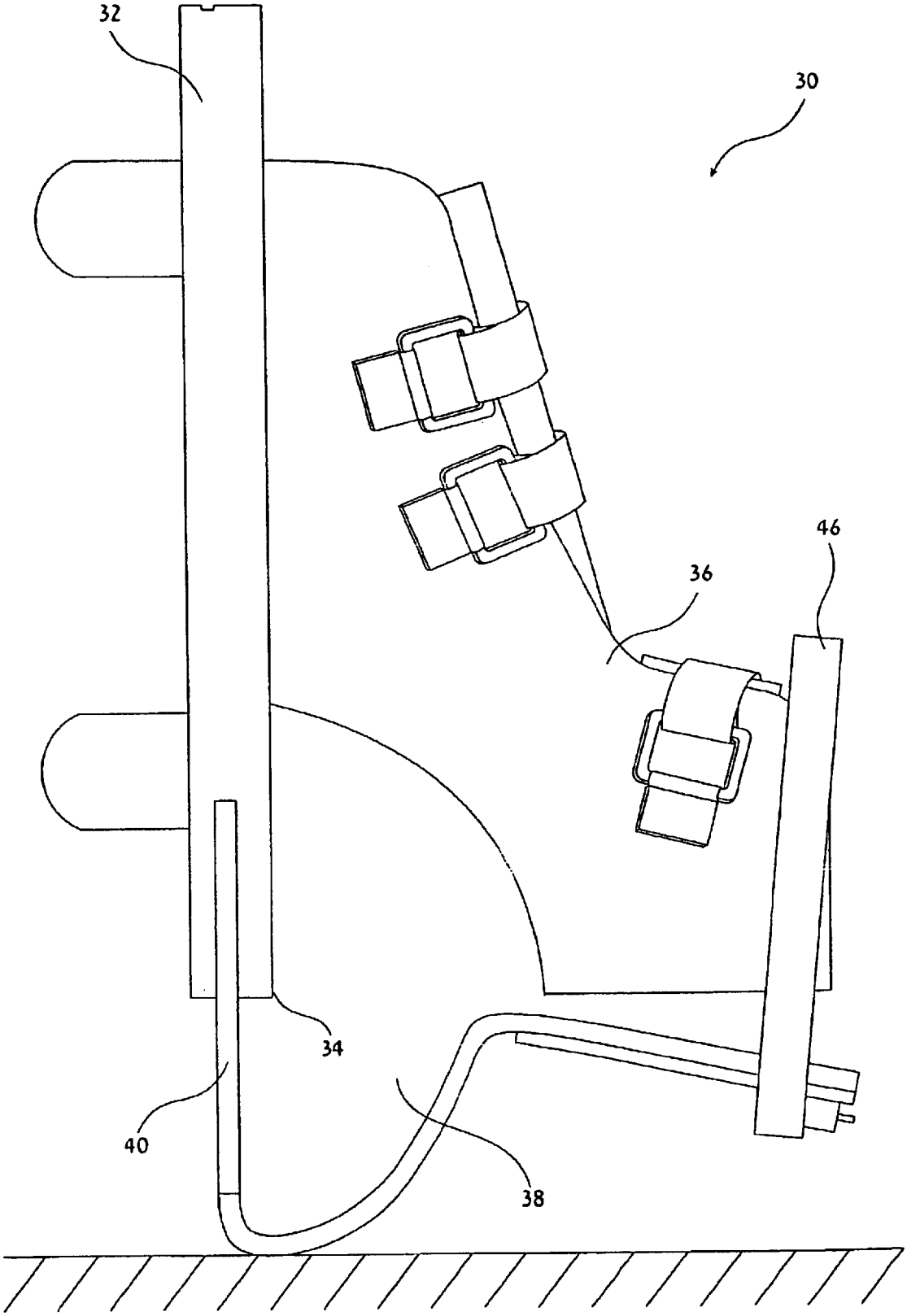
FIG. 9 is a schematic side view of the shoe of FIG. 8.

Another preferred implementation for pressure release bracket is illustrated in FIGS. 8 and 9. In this implementation, one part of pressure release bracket 40 engages slot 42 adjacent to the rear edge of the sole and the other part is reversibly connected to the upper part of the shoe or fixed around the leg of the wearer with straps 46. The shape and rigidity of pressure release bracket 40 is such that when used in conjunction with straps 46 pressure on the heel of the foot of a supine wearer is relieved, the heel is protected from painful or damaging incidental contact, and the weight of the foot is redistributed through straps 46 to the ankle and leg of the wearer. Straps 46 can be made from any suitable material, such as leather or woven material, and be tightened around the leg or ankle of the wearer using suitable means such as buckles or Velcro®.

As mentioned earlier, these features may optionally be used in combination with the above mentioned weight-shifting therapy features. Accordingly, the preferred embodiment shown here additionally features the track 16 and support block 18 described above.

Figure 10:
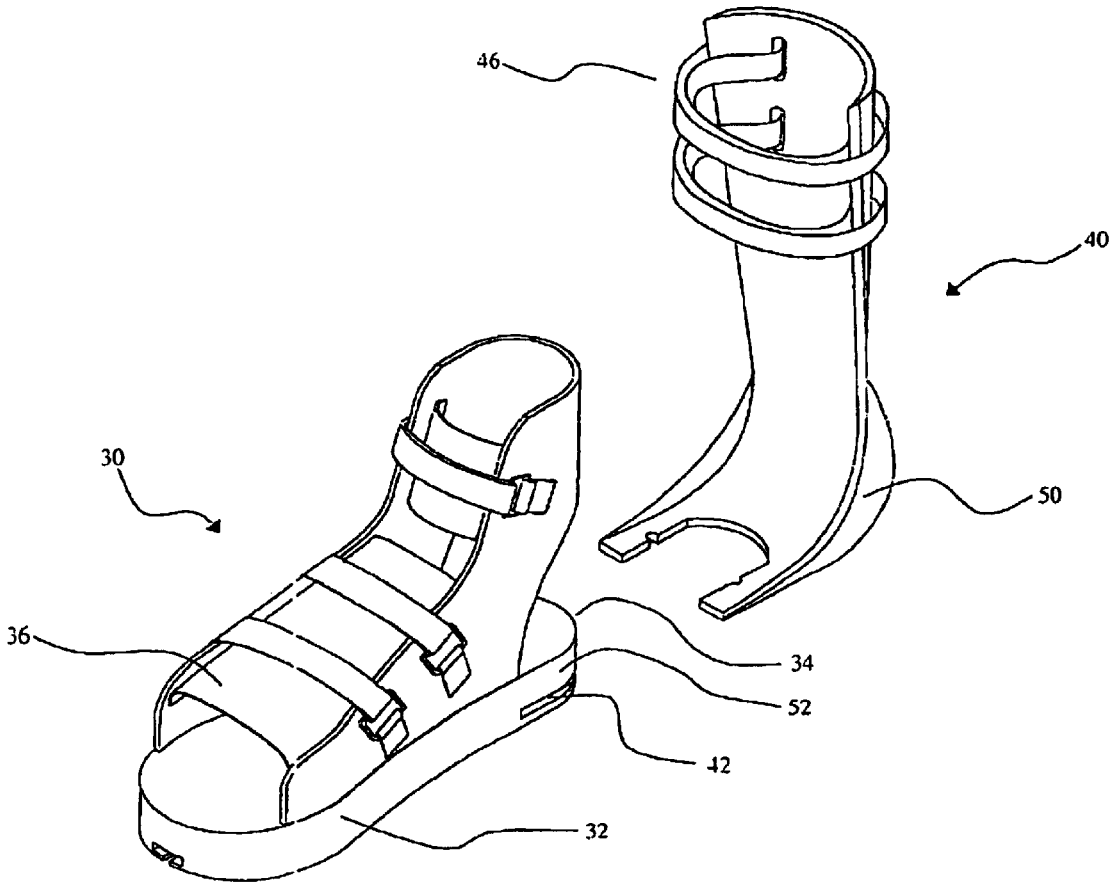
FIG. 10 is an isometric view of an additional embodiment of a therapeutic shoe, constructed and operative according to the teachings of the present invention, employing a further alternative pressure release bracket shown aligned for engagement with the sole.

A third preferred implementation for a pressure release bracket is illustrated in FIG. 10. Several of the elements and features illustrated here are similar to those in FIGS. 8 and 9 and are numbered accordingly. In this implementation of the pressure release bracket, the portion of the bracket adjacent to the heel of the foot is shaped so as to protect the heel not only while the wearer is reclined supinely but also while the wearer is lying on his or her side or when the foot or leg are rotated to the side. This is accomplished by a cupped configuration 50 that extends around to both sides of the heel, thereby supporting that part 52 of the side edge of the sole that is adjacent to the rear edge off the underlying surface. The bracket may be formed as a solid structure or with cutouts which will allow airflow to the protected area. As mentioned above, the pressure release bracket may be connected to the upper part of the shoe or fixed to the leg with straps 46. Optionally, the pressure release bracket may be configured substantially rigid, such that the rigidity produced when the pressure release bracket is strapped in place provides a further therapeutic benefit. In combination, the pressure release bracket and sole of the shoe provide substantially rigid preferably approximately right angle support for the foot when the foot is lifted off the ground during the course of the step. This feature may be of particular benefit to patients with a condition commonly referred to as "drop foot."

Figure 11:
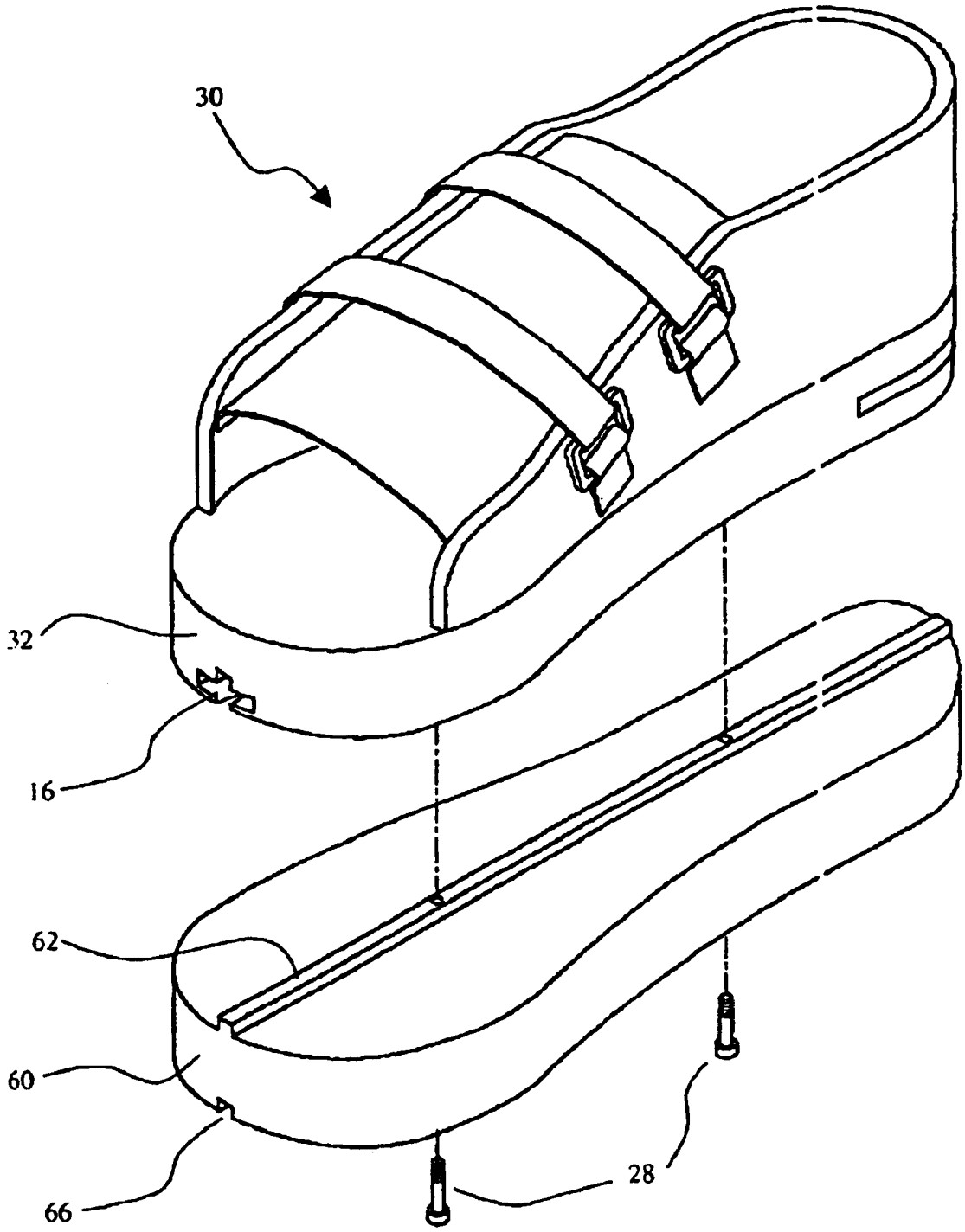
FIG. 11 and FIG. 12 are isometric views of a therapeutic shoe, disassembled and assembled respectively, constructed and operative according to the teachings of the present invention, employing an additional sole height adjustment platform.

In some therapeutic applications, it may be necessary to adjust the thickness of the sole of a therapeutic shoe. FIG. 11 shows a therapeutic shoe 30 similar to that mentioned above with a sole 32 and a recessed track 16. An additional sole height adjustment platform 60 is aligned for attachment to the bottom of the sole 32 of the shoe. As shown here, the platform is configured with a ridge that extends substantially parallel to a dimension of the platform termed "length" along a major portion of the length. It should be noted that the ridge may be in the form of raised portions along a line that extends substantially parallel to a dimension termed "length." In the example shown here, the platform is attached to the sole, the ridge is inserted into the recessed track 16 and held in place by the screw 28 and attachment plate configuration discussed in FIGS. 3*a* and 3*b*. It will be obvious to one skilled in the art there may be a need for varying the thickness of the platforms. The variation may be uniform, providing top and bottom surfaces the planes of which are substantially parallel. The variation may also by gradient thereby providing top and bottom surfaces the planes of which are at angle to each other. The angle may be side-to-side, front-to-back, or any prescribed combination. Further, with the aid of the alignment groove 66 on the bottom surface of the platform, a plurality of platforms may be used in concert to achieve the required sole elevation.

Figure 12:
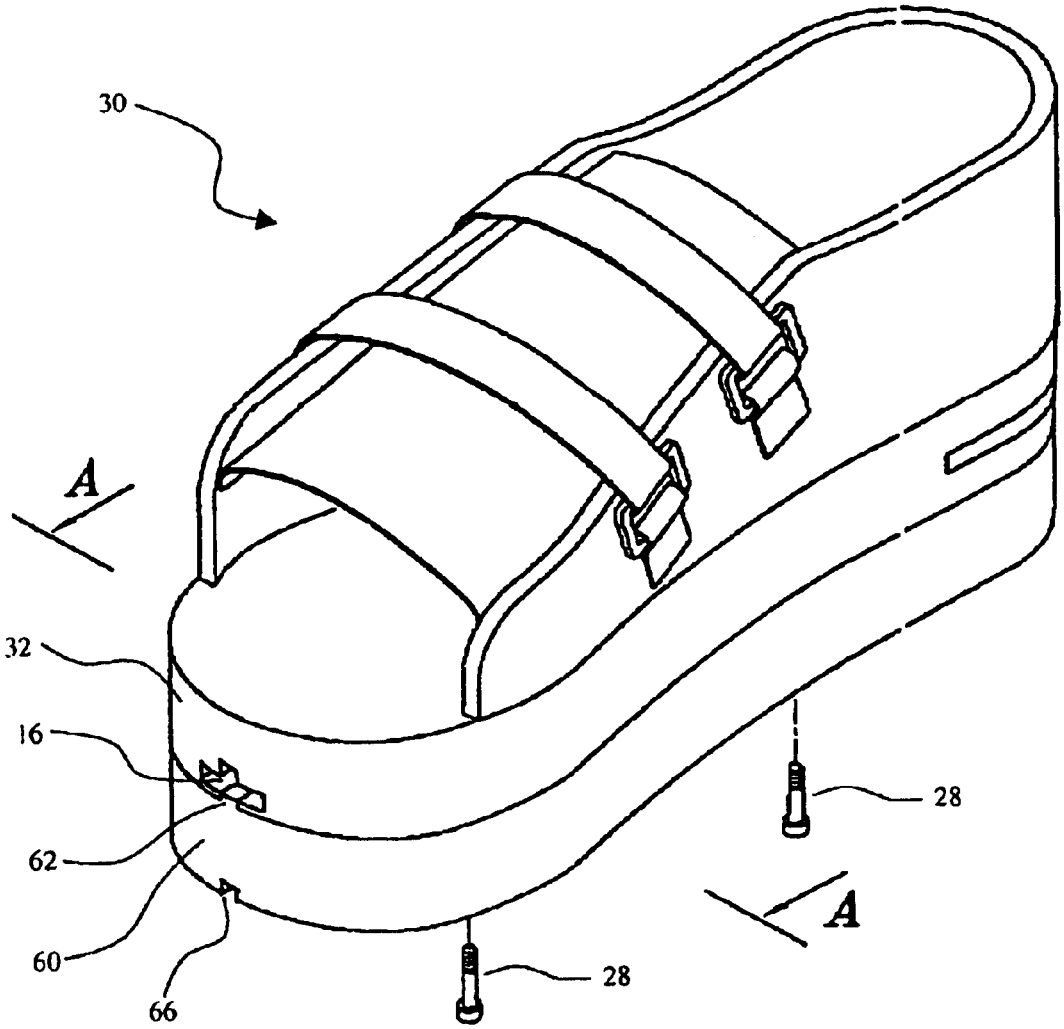

FIG. 12 shows the same components as FIG. 11 and is correspondingly numbered. Here, the platform is attached to the shoe.

Figure 13:
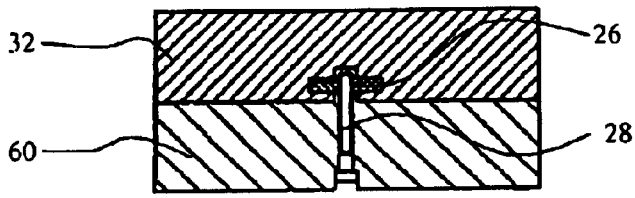
FIG. 13 is a cross-sectional detail of the sole and platform of FIG. 12.

FIG. 13 is a cross-section along line A—A of FIG. 12. Shown here, is the attachment plate 26 and screw 28 configuration used to attach the platform 60 to the sole 32 of the shoe.

It will be appreciated that the above descriptions are intended only to serve as examples, and that many other embodiments are possible within the spirit and scope of the present invention.

What is claimed is:

1. A therapeutic shoe comprising:

a. a sole providing an upper surface for supporting the foot of the wearer and a lower surface, said sole having a longest dimension;

b. an upper portion associated with said sole and configured to retain the foot of the wearer in contact with said sole;

c. a recessed track formed in said lower surface of said sole and extending substantially parallel to said longest dimension along a major portion of said longest dimension; and d. a support block having an engagement projection configured for engaging said recessed track and a load-supporting body configured to extend in a direction substantially perpendicular to said longest dimension, said support block being configured so as to be attachable to said lower surface at any one of a plurality of positions along substantially the entirety of said recessed track, and said engagement projection is configured with an engagement ridge and an attachment plate operatively connected to said engagement ridge with a tightening element for attaching said support block to said lower surface.

2. The shoe of claim 1, wherein said recessed track includes at least one undercut ridge, said recessed track being open at at least one end, and wherein said engagement projection is configured to engage said undercut ridge.

3. The shoe of claim 1, wherein said recessed track is a substantially T-shaped track open at at least one end, and wherein said engagement projection is formed with a complementary T-shaped cross-section.

4. The shoe of claim 1, wherein said load-supporting body is formed with a rounded lower profile as viewed along its direction of extension.

5. The shoe of claim 1, further comprising at least two threaded fastening elements for attaching said support block to said lower surface.

6. The shoe of claim 1, further comprising at least one additional support block having an engagement projection configured for engaging said recessed track and a load-supporting body configured to extend in a direction substantially perpendicular to said longest dimension, said support block and said additional support block being attachable at different positions along said recessed track.

7. The shoe of claim 1, additionally configured to avoid pressure on the heel of a foot while a wearer is lying in a supine position on an underlying surface, wherein said sole has a rear edge, said upper portion being configured to retain the foot in a position such that the heel of the foot lies adjacent to said rear edge, said upper portion having at least one opening adjacent to said rear edge so as to avoid contact with at least a part of the heel of the foot, the shoe further comprising a pressure release bracket configured to releasably engage said sole so that said sole is supported by said pressure release bracket with said rear edge raised above the underlying surface.

8. The shoe of claim 1, wherein, said sole includes a rear edge, said upper portion associated with said sole is configured to retain the foot of the wearer contact with said sole in a position such that the heel of the foot lies adjacent to said rear edge, said upper portion having at least one opening adjacent to said rear edge so as to avoid contact with at least a part of the heel of the foot, and a substantially one piece pressure release bracket releasably engages said sole so that said sole is supported by said pressure release bracket with said rear edge raised above the underlying surface.

9. The shoe of claim 8, wherein said sole features a slot adjacent to said rear edge, and wherein said pressure release bracket is implemented as a substantially flat sheet configured to engage said slot.

10. The shoe of claim 8, wherein said sole features a slot adjacent to said rear edge, and wherein said pressure release bracket is configured to engage said slot, configured to redistribute the weight of the foot to the ankle and leg, and configured to substantially protect the heel from incidental contact.

11. The shoe of claim 8 additionally configured to facilitate shifting the weight exerted on the foot of a wearer as required, wherein said sole has a longest dimension, the shoe further comprising:

a. a recessed track formed in said lower surface of said sole and extending substantially parallel to said longest dimension along a major portion of said longest dimension; and b. a support block having an engagement projection configured for engaging said recessed track and a load-supporting body configured to extend in a direction substantially perpendicular to said longest dimension, said support block being configured so as to be attachable to said lower surface at any one of a plurality of positions along substantially the entirety of said recessed track.

12. The shoe of claim 8, wherein said at least one opening is further open to portions of adjacent side edges on either side of said rear edge so as to avoid contact with at least pan of the back and sides of the heel of the foot.

13. The shoe of claim 12, wherein said pressure release bracket is further configured to support said sole with at lease a part of one of said adjacent side edges raised above the underlying surface when the foot and leg are rotated to bring said adjacent side edge into contact with the underlying surface.

14. A therapeutic shoe comprising:

a. a sole providing an upper surface for supporting the foot of the wearer and a lower surface, said sole having a longest dimension and a rear edge;

b. an upper portion associated with said sole and configured to retain the foot of the wearer in contact with said sole, said upper portion being configured to retain the foot in a position such that the heel of the foot lies adjacent to said rear edge, said upper portion having at least one opening adjacent to said rear edge so as to avoid contact with at least a part of the heel of the foot;

c. a recessed track formed in said lower surface of said sole and extending substantially parallel to said longest dimension along a major portion of said longest dimension;

d. a support block having an engagement projection configured for engaging said recessed track and a load-supporting body configured to extend in a direction substantially perpendicular to said longest dimension, said support block being configured so as to be attachable to said lower surface at any one of a plurality of positions along substantially the entirety of said recessed track; and e. a pressure release bracket configured to releasably engage said sole so that said sole is supported by said pressure release bracket with said rear edge raised above the underlying surface so as to avoid pressure on the heel of a foot while a wearer is lying in a supine position on an underlying surface.

* * * * *